US012181148B2

(12) United States Patent
Takeuchi et al.

(10) Patent No.: US 12,181,148 B2
(45) Date of Patent: Dec. 31, 2024

(54) TOTALLY AERATED COMBUSTION BURNER

(71) Applicants: RINNAI CORPORATION, Aichi (JP); BEST CORPORATION, Osaka (JP)

(72) Inventors: Masaru Takeuchi, Nagoya (JP); Hiroyuki Okamoto, Osaka (JP); Yusuke Nakagawa, Osaka (JP)

(73) Assignees: RINNAI CORPORATION, Aichi (JP); BEST CORPORATION, Osaka (JP)

( * ) Notice: Subject to any disclaimer, the term of this patent is extended or adjusted under 35 U.S.C. 154(b) by 443 days.

(21) Appl. No.: 17/845,268

(22) Filed: Jun. 21, 2022

(65) Prior Publication Data

US 2023/0023104 A1 Jan. 26, 2023

(30) Foreign Application Priority Data

Jul. 20, 2021 (JP) ..... 2021-119495

(51) Int. Cl.
*F23D 14/02* (2006.01)
*F23D 14/14* (2006.01)

(52) U.S. Cl.
CPC ..... *F23D 14/145* (2013.01); *F23D 14/02* (2013.01); *F23D 2203/103* (2013.01); *F23D 2212/201* (2013.01)

(58) Field of Classification Search
CPC .. F23D 14/145; F23D 14/02; F23D 2203/103; F23D 2212/201; F23D 2203/106
See application file for complete search history.

(56) References Cited

U.S. PATENT DOCUMENTS

| | | | | |
|---|---|---|---|---|
| 2018/0363897 | A1* | 12/2018 | Ono | F24H 1/145 |
| 2019/0024941 | A1* | 1/2019 | Ono | F23D 14/02 |
| 2019/0032916 | A1* | 1/2019 | Takeuchi | F23D 14/145 |
| 2019/0186784 | A1* | 6/2019 | Ono | F28D 7/1615 |
| 2020/0271353 | A1* | 8/2020 | Ono | F23D 14/02 |
| 2021/0356123 | A1* | 11/2021 | Akagi | F23D 14/36 |
| 2024/0027063 | A1* | 1/2024 | Shiraha | F23D 14/145 |
| 2024/0060640 | A1* | 2/2024 | Shiraha | F23D 14/46 |

FOREIGN PATENT DOCUMENTS

JP 2014-009838 A 1/2014

* cited by examiner

*Primary Examiner* — Alfred Basichas
(74) *Attorney, Agent, or Firm* — Future IP LLC; Tomoko Nakajima

(57) ABSTRACT

A totally aerated combustion burner has a combustion plate part through which an air-fuel mixture is ejected. The combustion plate part includes: an air-fuel mixture permeable body made from metallic fibers to allow the air-fuel mixture to pass therethrough; and a distribution plate having formed therein a multiplicity of distribution holes and being stacked on a back surface of the air-fuel mixture permeable body. An air-fuel mixture permeable body is constructed by laminating a plurality of metallic-fiber woven bodies which are woven by metallic-fiber threads obtained by bundling a plurality of metallic fibers relatively large in diameter. These metallic-fiber woven bodies are laminated such that a part of meshes in one metallic-fiber woven body overlaps a portion other than meshes in another metallic-fiber woven body, said one metallic-fiber woven body and said another metallic-fiber woven body that lies adjacent to each other in the laminating direction.

4 Claims, 7 Drawing Sheets

TOTALLY AERATED COMBUSTION BURNER

This claims priority under 35 U.S.C. § 119 to Japanese Patent Application No. 2021-119495, filed Jul. 20, 2021, which is incorporated by reference.

BACKGROUND OF THE INVENTION

1. Technical Field

The present invention relates to a totally aerated combustion burner which is provided with a combustion plate part through which an air-fuel mixture is ejected.

2. Related Art

In this kind of totally aerated combustion burner, there is conventionally known an arrangement in which the combustion plate part comprises: a permeable body through which the air-fuel mixture can pass (hereinafter referred to as "air-fuel mixture permeable body") made from metallic fibers; and a distribution plate having formed therein a multiplicity of distribution holes and being stacked on a back surface of the air-fuel mixture permeable body (see, e.g., patent document 1).

The air-fuel mixture permeable body is constructed by one metallic-fiber woven body made by weaving metallic-fiber threads that are obtained by bundling a plurality of metallic fibers. In order to improve the combustibility (particularly, resistance against lifting), it is necessary to disperse the air-fuel mixture moderately through the metallic-fiber woven body. Specifically, it is necessary to reduce the amount of ejection of the air-fuel mixture out of the meshes and also to make sure that an appropriate amount of air-fuel mixture permeates through the metallic-fiber threads so that, as a consequence, the flame to be formed by the combustion of the air-fuel mixture that has ejected from the meshes can be stabilized by a small flame that is hard to lifted and is formed by the combustion of the air-fuel mixture permeated through the metallic-fiber threads. For that purpose, it is required to make the meshes smaller and also to increase the number of metallic fibers per one metallic-fiber thread. Then, in order to increase the number of metallic fibers per one metallic-fiber thread and further to make smaller the meshes, flexibility will be required of the metallic fibers. As a solution, conventionally there used to have woven metallic-fiber woven bodies by using metallic-fiber threads of dozens of ultrafine metallic fibers of less than 0.04 mm in diameter, which are superior in flexibility. This kind of ultrafine metallic fibers are, however, higher in cost. Therefore, the air-fuel mixture permeable body constructed by the metallic-fiber woven body which is wound by metallic-fiber threads made up of ultrafine metallic fibers become fairly expensive.

By the way, larger-diameter metallic fibers above 0.07 mm in diameter are less expensive. Therefore, it is considered to weave a metallic-fiber woven body by metallic-fiber threads that are obtained by bundling such metallic fibers. However, in order to weave the metallic-fiber woven body by this kind of metallic-fiber threads, it is necessary to reduce the number of metallic fibers per one metallic-fiber thread, or to enlarge the meshes. This will make insufficient the dispersion of the air-fuel mixture in the air-fuel mixture woven body, resulting in poor combustibility.

PRIOR ART DOCUMENTS

[Patent Document] JP2014-9838A

SUMMARY

Problems that the Invention is to Solve

In view of the above points, this invention has a problem of providing a totally aerated combustion burner in which the combustion performance will not be deteriorated even without employing ultrafine metallic fibers, and in which the cost reduction of the air-fuel mixture permeable body can be attained.

Means for Solving the Problems

In order to solve the above problem, this invention is a totally aerated combustion burner comprising: a combustion plate part through which an air-fuel mixture is ejected, the combustion plate part including: an air-fuel mixture permeable body made from metallic fibers to allow the air-fuel mixture to pass therethrough; and a distribution plate having formed therein a multiplicity of distribution holes, and being stacked on a back surface of the air-fuel mixture permeable body, the back surface being defined as an upstream-side surface as seen along a flow of the air-fuel mixture through the air-fuel mixture permeable body, whereby the air-fuel mixture can be ejected through the distribution holes and the air-fuel mixture permeable body. In the totally aerated combustion burner: the air-fuel mixture permeable body is constructed by laminating a plurality of metallic-fiber woven bodies, each of the metallic-fiber woven bodies being made by weaving metallic-fiber threads obtained by bundling a plurality of metallic fibers; and the plurality of metallic-fiber woven bodies are laminated such that part of (partial) meshes in one metallic-fiber woven body that lies adjacent to another metallic-fiber woven body in a laminating direction, overlaps a portion other than meshes in said another metallic-fiber woven body.

According to this invention, even if the number of metallic fibers per one metallic-fiber thread decreases or the meshes become larger as a result of employing larger-diameter metallic fibers, the air-fuel mixture permeable body is constructed by laminating the plurality of metallic-fiber woven bodies such that a part of meshes in one metallic-fiber woven body that lies adjacent to another metallic-fiber woven body in the laminating direction, overlaps a portion other than meshes in said another metallic-fiber woven body. Therefore, dispersion of the air-fuel mixture through the air-fuel mixture permeable body is accelerated. There will thus be no possibility of deterioration in the combustibility. In addition, since larger-diameter metallic fibers are considerably less expensive, even if a plurality of metallic-fiber woven bodies are laminated, they are smaller in cost than one metallic-fiber woven body obtained by weaving metallic-fiber threads in which, like in the conventional example, ultrafine metallic fibers are bundled. In this manner, the cost of the air-fuel mixture permeable body can be reduced.

Further, according to this invention, preferably a number of metallic fibers per one metallic-fiber thread for said one metallic-fiber woven body is smaller than the number of metallic fibers per one metallic-fiber thread for said another metallic-fiber woven body, and the meshes in said one metallic-fiber woven body are smaller in size than the meshes in said another metallic-fiber woven body. According to this arrangement, in whichever positional relationship said one metallic-fiber woven body may be laminated relative to said another metallic-fiber woven body, the part other than the meshes in said one metallic-fiber woven body will overlap a part of the meshes in said another metallic-fiber woven body. Therefore, at the time of laminating a plurality of metallic-fiber woven bodies, there will be no need of controlling the position of each of the metallic-fiber woven bodies, thereby improving the ease in assembling. By the way, the number of metallic fibers per one metallic-fiber thread for said another metallic-fiber woven body in which mesh sizes are enlarged, is relatively large in quantity, an adequate amount of air-fuel mixture will be permeated through this metallic-fiber threads. In consequence, a flame that is hard to be lifted is stably formed, thereby securing the resistance to the lifting characteristics.

Further, in case the plurality of metallic-fiber woven bodies are constructed by the same kind of metallic-fiber woven bodies of the same size in the meshes obtained by weaving the same kind of metallic-fiber threads which are the same in number of metallic fibers per one metallic thread, if a course direction of said one metallic-fiber woven body crosses the course direction of said another metallic-fiber woven body, the plurality of metallic-fiber woven bodies are laminated such that a part of meshes in said one metallic-fiber woven body overlaps a portion other than meshes in said another metallic-fiber woven body. According to this arrangement, when a plurality of metallic-fiber woven bodies are laminated, the course direction of each of the metallic-fiber woven bodies must be controlled. But this control is easier than the control of the positions of each of the metallic-fiber woven bodies. Therefore, the ease in assembling will not be deteriorated so much.

Still furthermore, the plurality of metallic-fiber woven bodies may be constructed by weaving the same kind of metallic-fiber threads that are equal in number of metallic fibers per one metallic-fiber thread. The shape of the meshes in said one metallic-fiber woven body and the shape of the meshes in said another metallic-fiber woven body may be made different from each other by varying the way of weaving the meshes. It may thus be so arranged that a part of meshes in said one metallic-fiber woven body overlaps a portion other than meshes in said another metallic-fiber woven body. This arrangement can similarly improve the ease of assembling.

PREFERRED EMBODIMENTS

For Carrying Out the Invention

Figure 1:
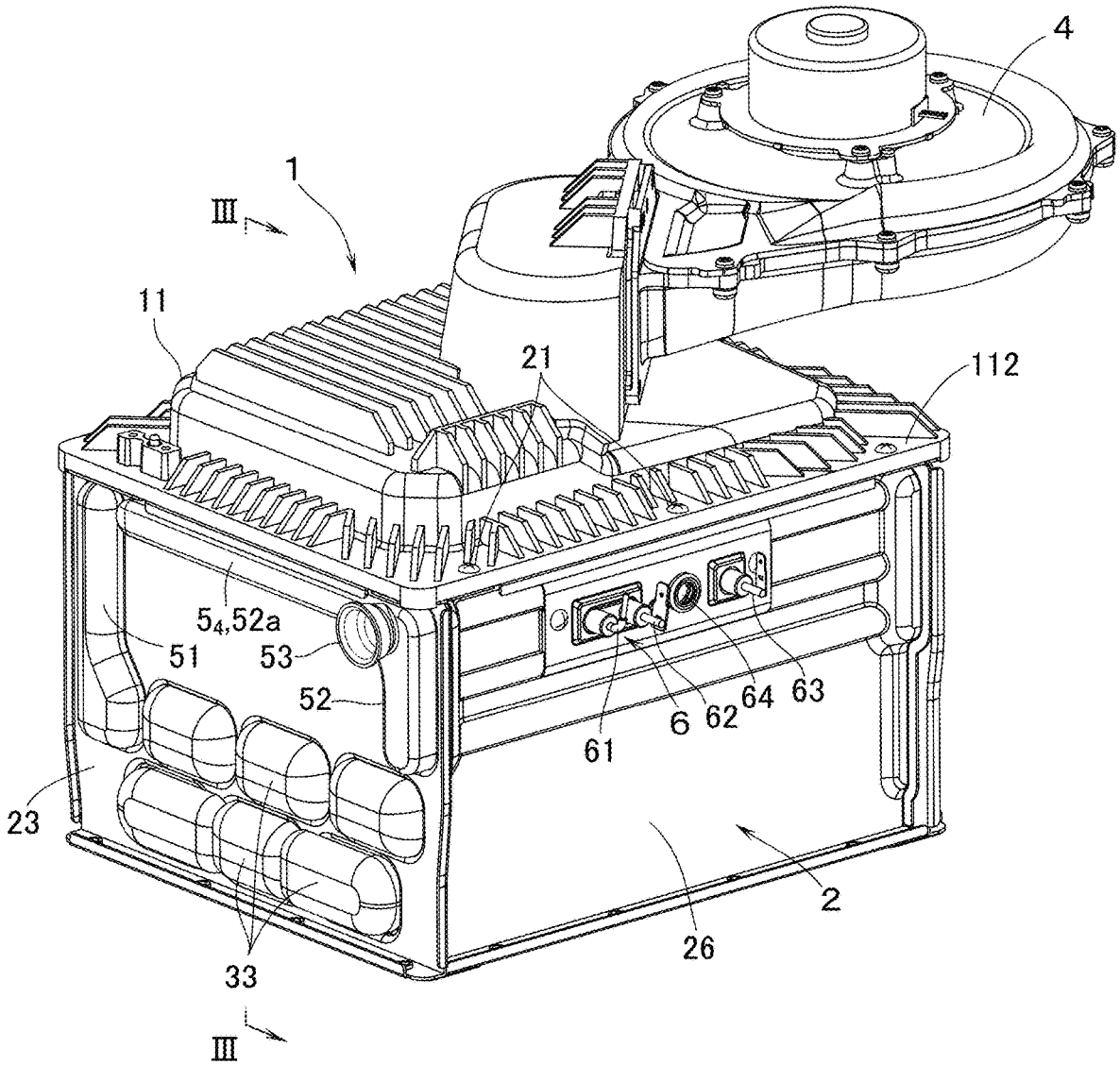
FIG. 1 is a perspective view of a combustion apparatus equipped with a totally aerated combustion burner according to an embodiment of this invention.

A combustion apparatus shown in FIG. 1 through FIG. 4 is provided with: a totally aerated combustion burner 1 having a burner body 11 which is supplied inside thereof with an air-fuel mixture (mixture gas of fuel gas and primary air), and a combustion plate part 12 which covers a downward open surface 111 of the burner body 11; and a combustion box 2 having a box flange part 22 at an upper end thereof which is fastened with screws 21 to a body flange part 112 enclosing the open surface 111 of the burner body 11. The combustion box 2 has housed therein a heat exchanger 3 for hot water supply.

The heat exchanger 3 is made up of a fin-tube type of heat exchanger provided with a multiplicity of fins 31 and a plurality of heat-absorbing tubes 32 which penetrate these fins 31. On an outside surface of side plates 23, 24 on laterally one side and the opposite side of the combustion box 2, there are mounted a plurality of connection covers 33 which define connection passages of the two heat absorbing tubes 32, 32 that lie next between each of the side plates 23, 24. In this manner, all the heat-absorbing tubes 32 are connected together in series with one another. Further, the connection covers 33 which define connection passages between the side plates 24 of the laterally opposite side are provided with a water inlet 34, the connection passages being connected to the heat absorbing tubes 32 on an upstream end of the heat exchanger 3.

Figure 2:
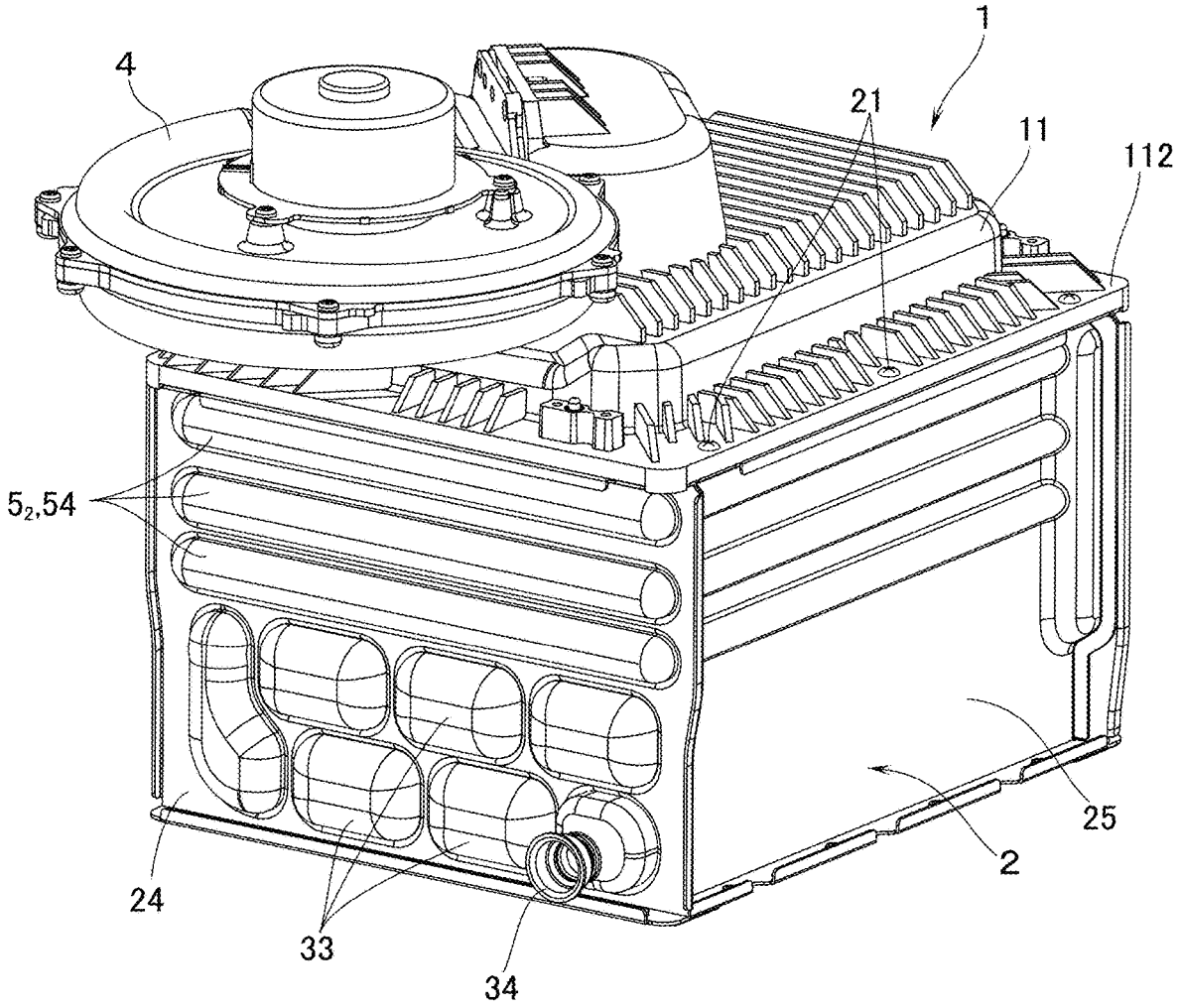
FIG. 2 is a perspective view of the combustion apparatus as viewed from a side opposite to that in FIG. 1.
Figure 3:
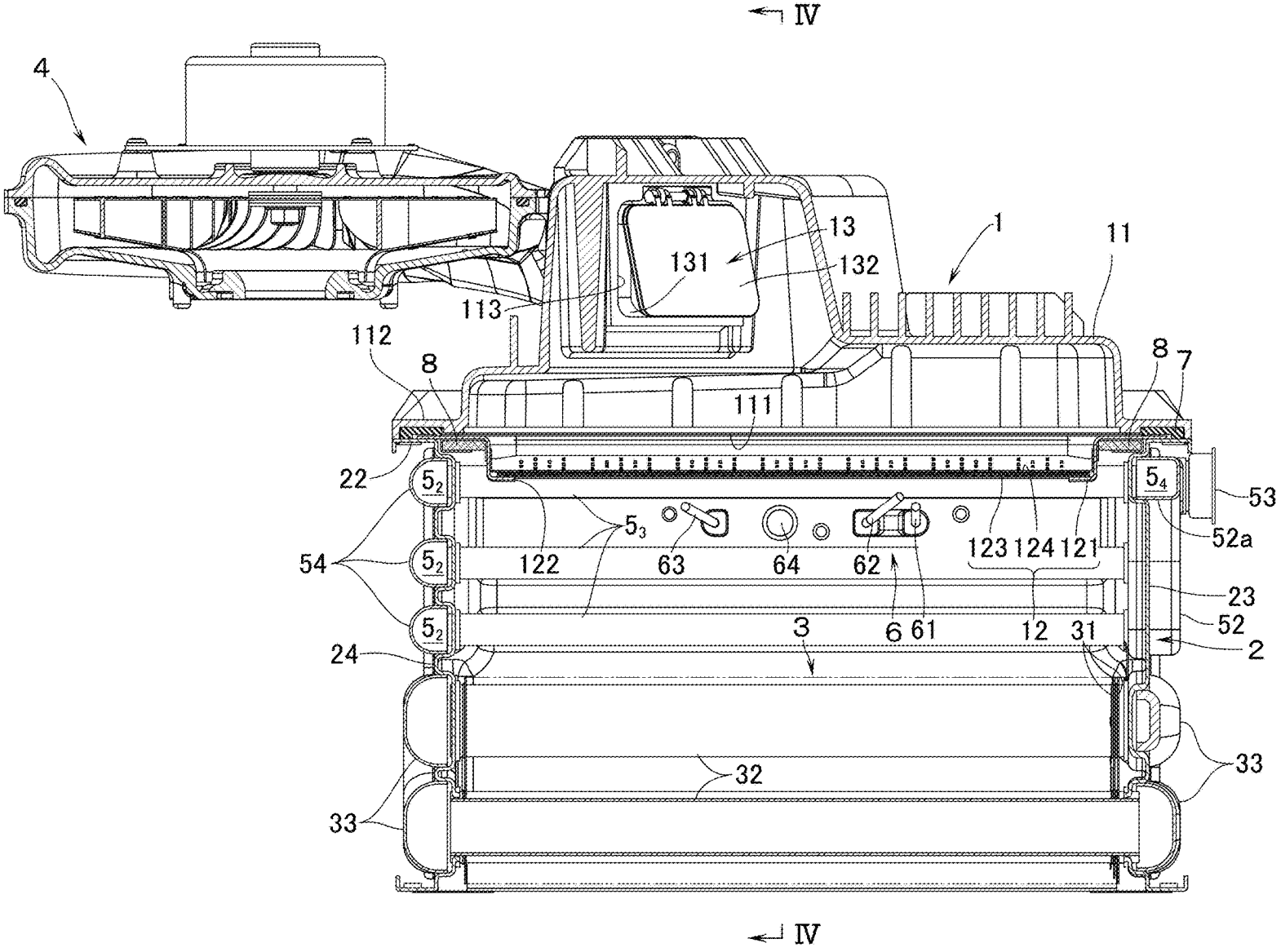
FIG. 3 is a sectional view cut away along the line III-III in FIG. 1.
Figure 4:
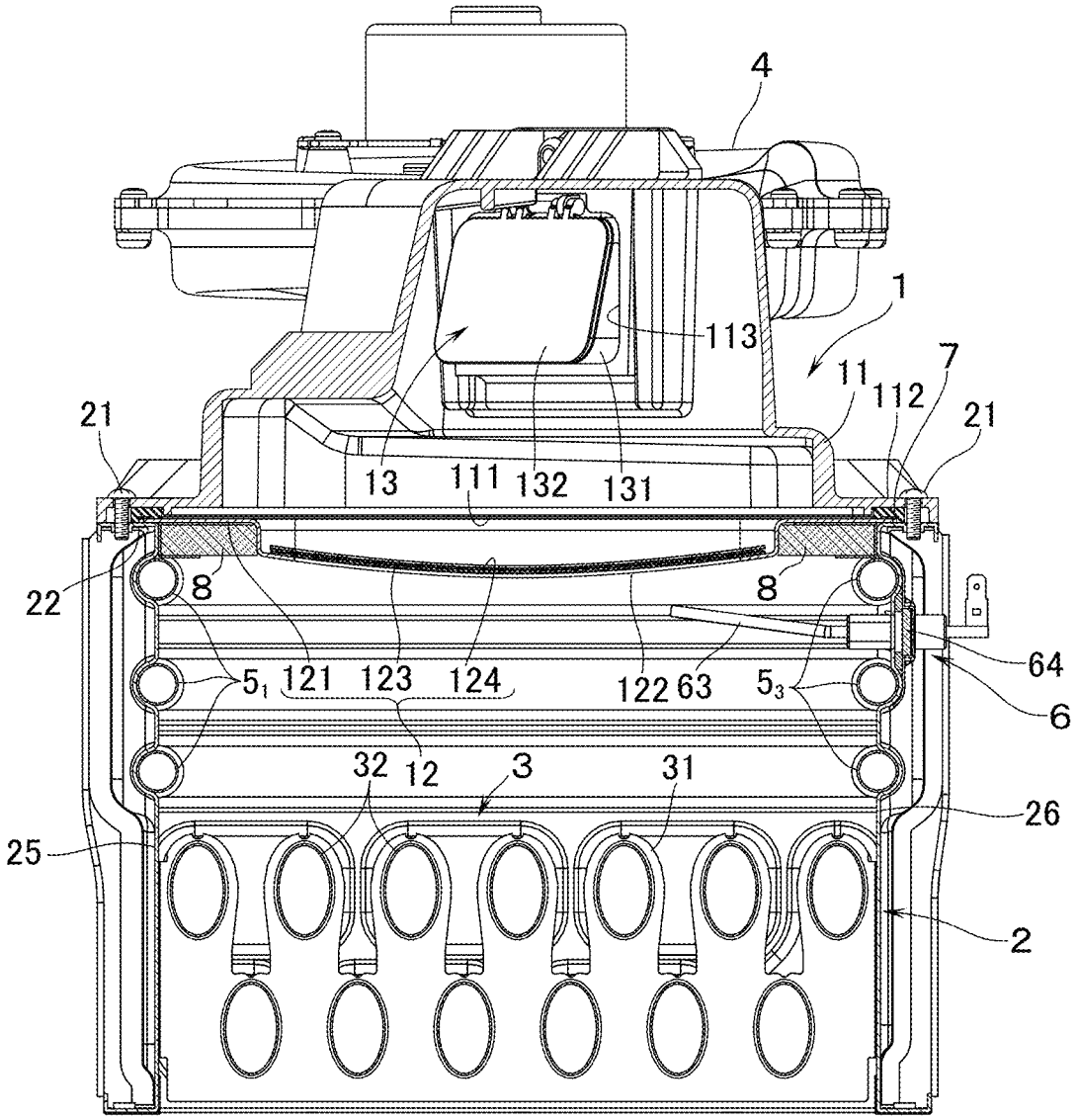
FIG. 4 is a sectional view cut away along the line IV-IV in FIG. 3.

Furthermore, on an inside of the rear-side side plate 25 of the combustion box 2, the inside being above the heat exchanger 3, there are disposed vertically arranged three pieces of first water passages 51 made up of tubes, in a manner to contact the rear-side side plate 25. Also on an inside of the front-side side plate 26 of the combustion box 2, the inside being above the heat exchanger 3, there are disposed vertically arranged three pieces of third water passages $\mathbf{5}_3$ made up of tubes, in a manner to contact the front-side side plate 26. In addition, on an outside surface of the laterally one-side side plate 23 of the combustion box 2, there are mounted: an inlet-side header cover 51 which defines a connection passage which connects the vertically disposed three pieces of first water passages 51 to the heat absorbing tube 32 on a downstream end of the heat exchanger 3, between the laterally one-side side plate 23; and an outlet-side header cover 52 which defines a connection passage for the vertically disposed three water passages $\mathbf{5}_3$ between the laterally one-side side plate 23; and a hot water outlet 53 is disposed on the outlet-side header cover 52. Furthermore, as shown in FIGS. 2 and 3, the laterally opposite side of the side plate 24 of the combustion box 2 is provided with second water passages $\mathbf{5}_2$ which connect the rear-side first water passages 51 and the front-side third water passages $\mathbf{5}_3$. Each of the second water passages $\mathbf{5}_2$ is made up of a laterally inward dent which is formed in the side plate 24; and a cover 54 which is mounted on an outer surface of the side plate 24 in a manner to cover the dent. It is thus so arranged that the water to be supplied from the water inlet 34 is heated by the heat exchanger 3, and the heated water flows out of the hot water outlet 53 through the connection passage inside the inlet-side header cover 51, the first water passages $5_1$, the second water passages $5_2$, and the third water passages $5_3$, and the connection passage inside the outlet-side header cover 52. In addition, the laterally one-side side plate 23 of the combustion box 2 is provided with a fourth water passage 54 which extends rearward from an upper portion of the connection passage inside the outlet-side header cover 52, the fourth water passage 54 being made up of a laterally inward dent which is formed in the side plate 23; and a cover 52*a* which covers this dent and which is integral with the outlet-side header cover 52. It is thus so arranged that each of the side plates 23-26 of the combustion box 2 is cooled by the water which flows through these first through fourth water passages $5_1$-$5_4$.

Further, the front-side side plate 26 of the combustion box 2 has mounted thereon electrode parts 6 which are protruded through the side plate portion between the two, i.e., the first and the second from the top, of the third water passages $5_3$, $5_3$, so as to protrude into the combustion box 2, the electrode parts 6 inclusive of an ignition electrode 61, a grounding electrode 62, and a flame rod 63. The electrode parts 6 are additionally provided with an inspection window 64 through which the inside of the combustion box 2 can be visually inspected.

Next, detailed description will be made of the totally aerated combustion burner 1. The burner body 11 is provided with an inlet port 113 for connecting thereto a fan 4 which supplies an air-fuel mixture. The inlet port 113 has mounted thereon a check valve 13 for preventing the air-fuel mixture, that remains inside the burner body 11 at the time of stopping of the fan 4, from flowing backward to the side of the fan 4. The check valve 13 is made up of: a resin-made valve box 131 which is built into the inlet port 113; and a resin-made valve plate 132 rotatably mounted, so as to be freely opened or closed, in an opening portion of the valve box 131, the opening portion facing the inside of the burner body 11.

Figure 5:
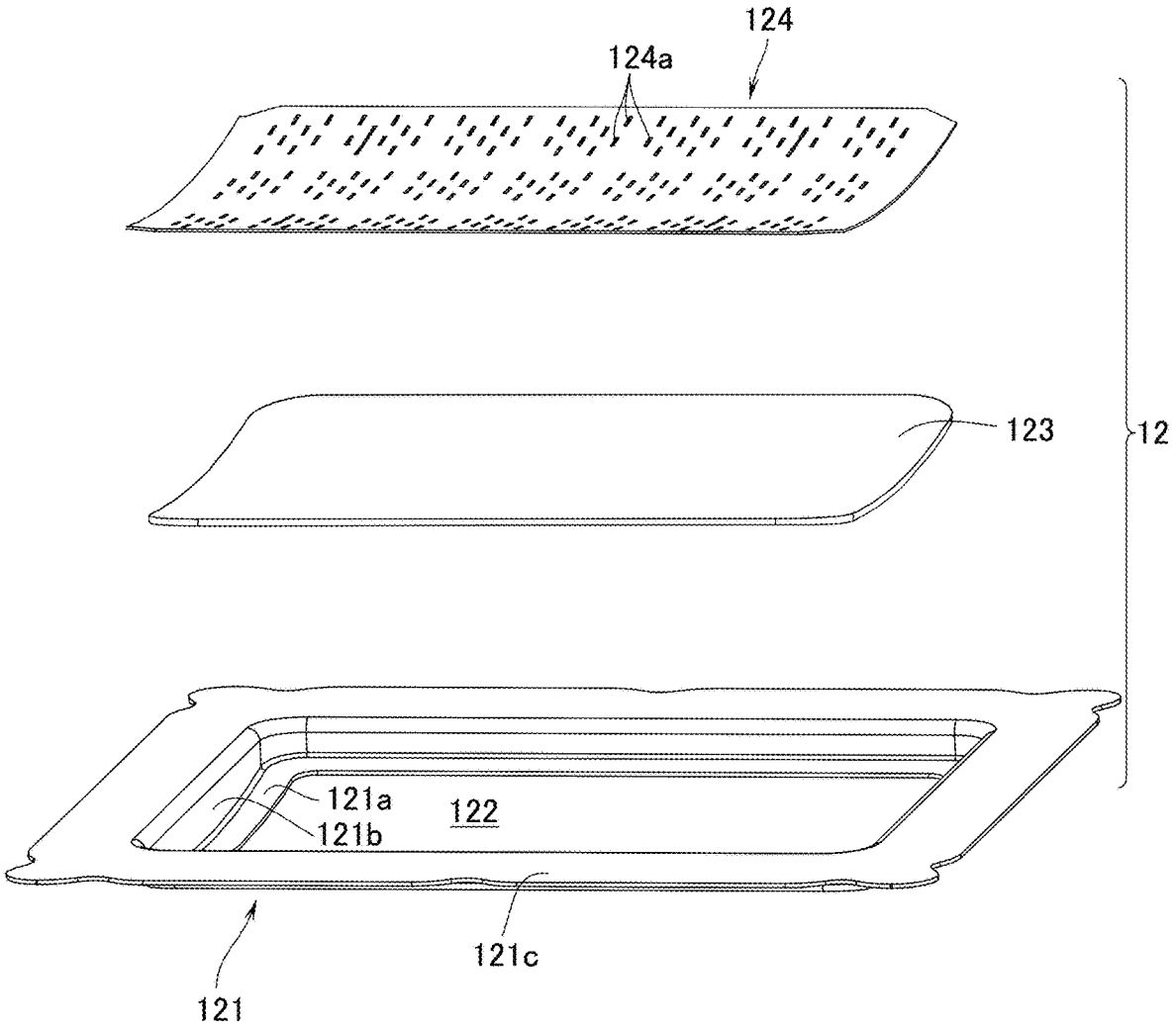
FIG. 5 is a perspective view in an exploded state of a combustion plate part of the totally aerated combustion burner according to this embodiment.
Figure 6:
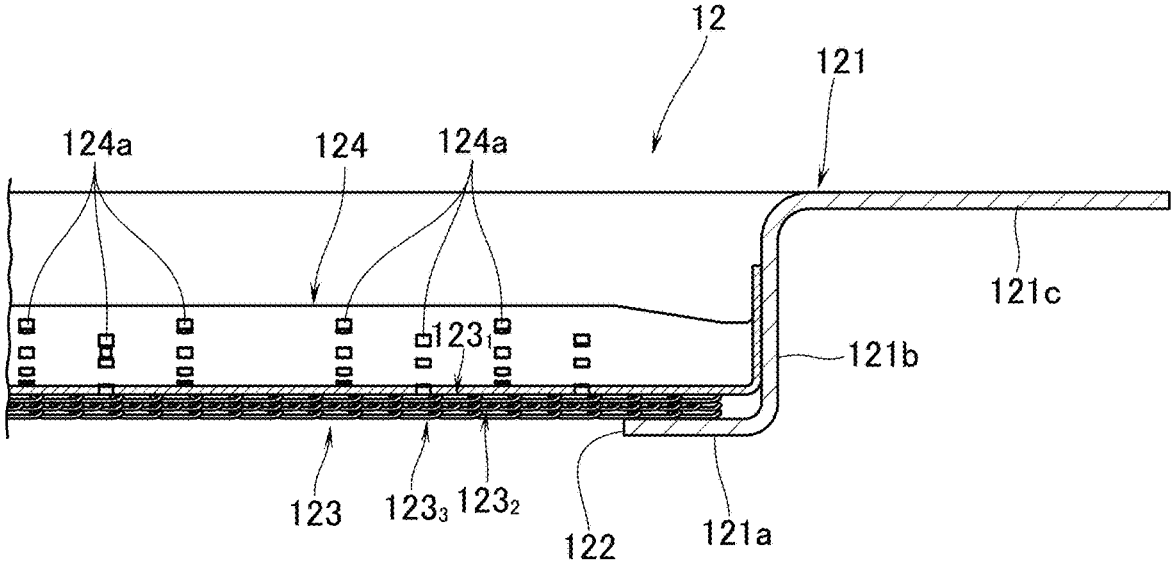
FIG. 6 is an enlarged sectional view of an essential portion in an assembled state of the combustion plate part in FIG. 5.

With reference also to FIG. 5 and FIG. 6, the combustion plate part 12 has: a burner frame 121 in the shape of a picture frame; an air-fuel mixture permeable body 123 which is made from metallic fibers disposed in a manner to cover, from the burner-body side (upward), an opening 122 enclosed by the burner frame 121; and a distribution plate 124 which has formed therein a multiplicity of distribution holes 124*a* and which is stacked on a back surface of the air-fuel mixture permeable body, the back surface thereof being defined as an upstream-side surface as seen along a flow of the air-fuel mixture through the air-fuel mixture permeable body 123. In this arrangement, the air-fuel mixture supplied into the burner body 11 is ejected, through the distribution holes 124*a* and the air-fuel mixture permeable body 123, out of the opening 122, thereby performing totally aerated combustion (combustion requiring no secondary air). The opening 122 is curved into an arcuate shape in cross section in the front-to-back direction. Similarly, the air-fuel mixture permeable body 123 and the distribution plate 124 are also curved into the arcuate shape in cross section in the front-to-back direction.

The burner frame 121 has: an opening peripheral part 121*a* that is positioned on the same plane as the opening 122; a side-plate part 121*b* which is bent from the opening peripheral part 121*a* to the burner-body 11 side (i.e., upward); and a frame flange part 121*c* which protrudes outward from an upper end of the side-plate part 121*b*. The combustion plate part 12 is assembled, in a state in which the distribution plate 124 is placed on (i.e., is overlapped with) the rear surface of the air-fuel mixture permeable body 123, peripheral portion of the permeable body 123 and the distribution plate 124 is spot-welded, at a certain spacing, to the opening peripheral part 121*a* of the burner frame 121. The frame flange part 121*c* is sandwiched into a space between the body flange part 112 and the box flange part 22. Further, by interposing a packing 7 between the frame flange part 121*c* and the body flange part 112, sealing properties are secured. Still furthermore, a thermal insulation material 8 is mounted on a lower surface of the frame flange part 121*c*.

Figure 7A:
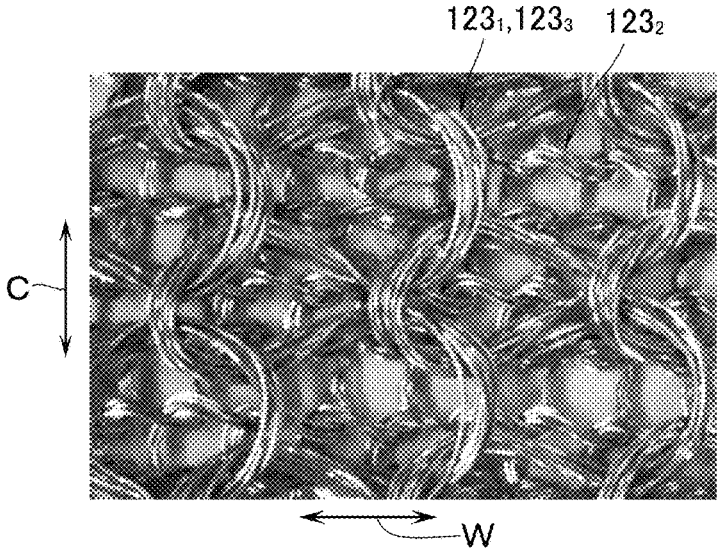
FIG. 7A is an enlarged plan view in a laminated state of one metallic-fiber woven body and another metallic-fiber woven body, that lie adjacent to each other in the laminating direction and serve as constituent elements of the air-fuel mixture permeable body to be used in the combustion plate part of the totally aerated combustion burner according to this embodiment.
Figure 7B:
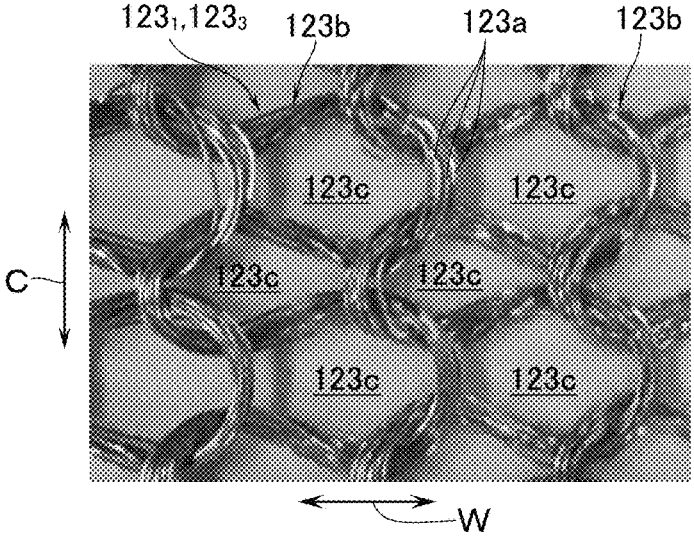
FIG. 7B is an enlarged plan view of a portion of said one metallic-fiber woven body that lies adjacent in the laminating direction.
Figure 7C:
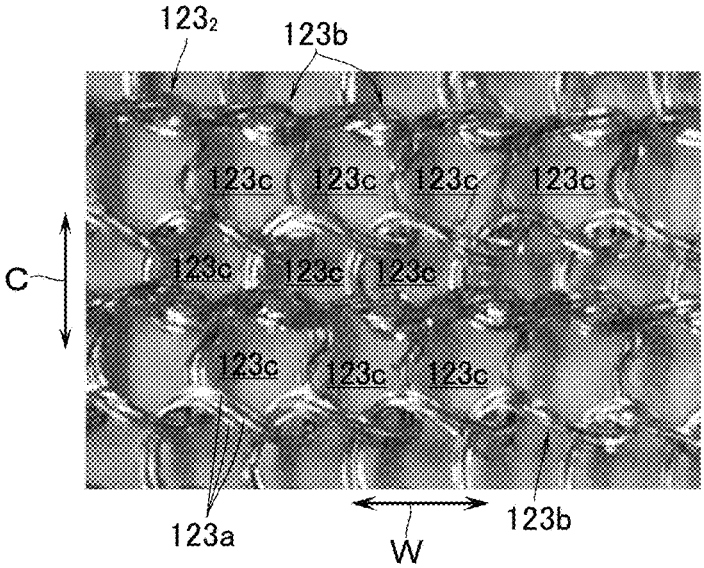
FIG. 7C is an enlarged plan view of a portion of said another metallic-fiber woven body that lies adjacent in the laminating direction.

The air-fuel mixture permeable body 123 is constructed by laminating a plurality of (e.g., three) metallic-fiber woven bodies $123_1$, $123_2$, $123_3$. These three metallic-fiber woven bodies $123_1$, $123_2$, $123_3$ get spot welded together at a plurality of spots so that they do not get peeled off from each other. With reference also to FIGS. 7A, 7B, 7C, each of the metallic-fiber woven bodies $123_1$, $123_2$, $123_3$ is formed by weaving metallic-fiber threads 123*b* obtained by bundling a plurality of relatively larger-diameter metallic fibers 123*a* whose diameters are between 0.07 mm and 0.2 mm and which are made by heat-resistant metal (e.g., FCHW2 according to product specification). In this embodiment the way of weaving the metallic-fiber woven bodies $123_1$, $123_2$, $123_3$ is by means of knitting, but other ways of weaving such as rib stitching, purl stitching and the like may also be employed. By the way, metallic fibers whose diameters are less than 0.07 mm are likely to be higher in cost. Metallic fibers, on the other hand, whose diameters exceed 0.2 mm will have too high a rigidity. Therefore, it is preferable to select the diameters of the metallic fibers 123*a* between 0.07 mm and 0.2 mm as described above.

As shown in FIG. 7A, the above-mentioned three pieces (sheets) of metallic-fiber woven bodies $123_1$, $123_2$, $123_3$ are laminated in the following manner. Namely, part of meshes 123*c* in one metallic-fiber woven body that lies adjacent in the laminating direction, to be more specific, meshes 123*c* in the first metallic-fiber woven body $123_1$ on an upstream side (upper side in FIG. 6) of the flow of the air-fuel mixture, or meshes 123*c* in the third metallic-fiber woven body $123_3$ on a downstream side (lower side in FIG. 6) of the flow of the air-fuel mixture, partly overlaps (or covers) a portion other than the meshes 123*c* in another metallic-fiber woven body that lies adjacent in the laminating direction, to be more specific, in the intermediate second metallic-fiber woven body $123_2$.

According to this arrangement, by employing large-diameter metallic fibers 123*a*, even if the number of metallic fibers 123*a* per one metallic-fiber thread 123*b* becomes fewer or even if the meshes 123*c* become larger, the portion other than the meshes 123*c* in the second metallic-fiber woven body $123_2$ will overlap the meshes 123*c* in each of the first and the third metallic-fiber woven bodies $123_1$, $123_3$. Therefore, the dispersion of the air-fuel mixture will be accelerated in the air-fuel mixture permeable body 123. There will thus be no deterioration in the combustibility. Further, since the larger-diameter metallic fibers 123*a* are considerably less expensive, even if three sheets of the first through the third metallic-fiber woven bodies $123_1$, $123_2$, $123_3$ are laminated, they are less expensive than one metallic-fiber woven body that is woven by metallic-fiber threads obtained by bundling ultrafine metallic fibers less than 0.04 mm in diameter as in the conventional example. Cost of the air-fuel mixture permeable body 123 can thus be reduced.

By the way, in case the first, the second, and the third metallic-fiber woven bodies $123_1$, $123_2$, $123_3$ are constructed by the same kind of metallic-fiber woven bodies of the same size in the meshes 123*c*. The metallic-fiber woven bodies are made by weaving the same kind of metallic-fiber thread 123*b* that are same in number of metallic fibers 123*a* per one metallic-fiber thread 123*b*, the first, the second, and the third metallic-fiber woven bodies $\mathbf{123}_1$, $\mathbf{123}_2$, $\mathbf{123}_3$ are laminated so that the meshes 123*c* of the second metallic-fiber woven bodies 1232 do not overlap a part of the meshes in each of the first and the third metallic-fiber woven bodies $\mathbf{123}_1$, $\mathbf{123}_3$. In this arrangement, the portion other than the meshes 123*c* in the second metallic-fiber woven bodies $\mathbf{123}_2$ overlap parts of the meshes 123*c* in the first and the third metallic-fiber woven bodies $\mathbf{123}_1$, $\mathbf{123}_3$. However, in this arrangement, at the time of laminating the first, the second, and the third metallic-fiber woven bodies $\mathbf{123}_1$, $\mathbf{123}_2$, $\mathbf{123}_3$, it becomes necessary to control the positions of each of the first, the second, and the third metallic-fiber woven bodies $\mathbf{123}_1$, $\mathbf{123}_2$, $\mathbf{123}_3$, resulting in poor assembling efficiency.

As a solution, in this embodiment, the meshes 123*c* in the second metallic-fiber woven body $\mathbf{123}_2$ as shown in FIG. 7C are made smaller in size than the meshes 123*c* in each of the first and the third metallic-fiber woven bodies $\mathbf{123}_1$, $\mathbf{123}_3$ as shown in FIG. 7B. For example, the meshes 123*c* in the first and the third metallic-fiber woven bodies $\mathbf{123}_1$, $\mathbf{123}_3$ have an average pitch of 4.0 mm in the course direction (direction shown by an arrow C), and an average pitch of 4.0 mm in the wale direction (direction shown by an arrow W). The meshes 123*c* in the second metallic-fiber woven body $\mathbf{123}_2$ have an average pitch of 2.5 mm in the course direction, and an average pitch of 1.5 mm in the wale direction. According to this arrangement, in whatever positional relationship the second metallic-fiber woven body $\mathbf{123}_2$ may be laminated relative to the first and the third metallic-fiber woven bodies $\mathbf{123}_1$, $\mathbf{123}_3$, the portion other than the meshes 123*c* in the second metallic-fiber woven body $\mathbf{123}_2$ will finally overlap a part of the meshes 123*c* in the first and the third metallic-fiber woven bodies $\mathbf{123}_1$, $\mathbf{123}_3$. Therefore, at the time of laminating the first, the second, and the third metallic-fiber woven bodies $\mathbf{123}_1$, $\mathbf{123}_2$, $\mathbf{123}_3$, there will be no need of controlling the position of each of the metallic-fiber woven bodies $\mathbf{123}_1$, $\mathbf{123}_2$, $\mathbf{123}_3$, thereby improving the ease of assembling.

In order to minimize the meshes 123*c*, it is necessary to reduce the rigidity of the metallic-fiber threads 123*b*. Therefore, the number of metallic fibers 123*a* per one metallic-fiber thread 123*b* for the second metallic-fiber woven body $\mathbf{123}_2$, whose meshes are made smaller, is arranged to be smaller (e.g., 4) than the number (e.g., 8) of metallic fibers 123*a* per one metallic-fiber thread 123*b* for the first and the third metallic-fiber woven bodies $\mathbf{123}_1$, $\mathbf{123}_3$ whose meshes are made larger. The number of metallic fibers 123*a* per one metallic fiber thread 123*d* for the first and the third metallic-fiber woven bodies $\mathbf{123}_1$, $\mathbf{123}_3$ is relatively large in number (quantity). Therefore, an adequate amount of air fuel mixture permeates through these metallic-fiber threads 123*b* so that a flame harder to be lifted can be stably formed, thereby securing the resistance to the lifting properties.

Descriptions have so far been made of the embodiments of this invention with reference to the drawings. This invention shall, however, not be limited to the above. For example, the first, the second, and the third metallic-fiber woven bodies $\mathbf{123}_1$, $\mathbf{123}_2$, $\mathbf{123}_3$ may be constructed by the same kind of metallic-fiber woven bodies of the same size in the meshes 123*c* obtained by weaving the same kind of metallic-fiber thread 123*b* that are the same in number of metallic fibers per one metallic-fiber thread 123*b*. A course direction (or wale direction) of the second metallic-fiber woven body $\mathbf{123}_2$ may be arranged to cross the course direction of each of the first and the third metallic-fiber woven bodies $\mathbf{123}_1$, $\mathbf{123}_3$. In this arrangement, too, the portion other than the meshes 123*c* in the second metallic-fiber woven bodies $\mathbf{123}_2$ overlaps a portion of the meshes 123*c* in each of the first and the third metallic-fiber woven bodies $\mathbf{123}_1$, $\mathbf{123}_3$. In this case, at the time of laminating the first, the second, and the third metallic-fiber woven bodies $\mathbf{123}_1$, $\mathbf{123}_2$, $\mathbf{123}_3$, the course direction of each of the metallic-fiber woven bodies $\mathbf{123}_1$, $\mathbf{123}_2$, $\mathbf{123}_3$ must be controlled. This control, however, is relatively easier as compared with the control of position of each of the metallic-fiber woven bodies $\mathbf{123}_1$, $\mathbf{123}_2$, $\mathbf{123}_3$. The ease in assembling will not be deteriorated so much.

Still furthermore, the first, the second, and the third metallic-fiber woven bodies $\mathbf{123}_1$, $\mathbf{123}_2$, $\mathbf{123}_3$ are supposed to have been constructed by metallic-fiber woven bodies by weaving the same kind of metallic-fiber threads 123*b* that are same in number of metallic fibers 123*a* per one metallic-fiber thread 123*b*. The shape of meshes 123*c* in each of the first and the third metallic-fiber woven bodies $\mathbf{123}_1$, $\mathbf{123}_3$ may be made different from the shape of meshes 123*c* in the second metallic-fiber woven body $\mathbf{123}_2$, by varying the way of weaving the meshes, such that a portion of the meshes in each of the first and the third metallic-fiber woven bodies $\mathbf{123}_1$, $\mathbf{123}_3$ overlaps a portion other than the meshes 123*c* of the second metallic-fiber woven body $\mathbf{123}_2$. Still furthermore, in the above-mentioned embodiments, the number of the metallic-fiber woven body which constitutes the air-fuel mixture permeable body 123 is defined to be three pieces (or sheets), but this number may be two or above four.

Furthermore, in the totally aerated combustion burner 1 according to the above-mentioned embodiments, the open surface 111 of the burner body 11 is disposed so as to look downward. But this invention can similarly be applicable to a totally aerated combustion burner whose open surface 111 looks upward. Further, in the above-mentioned embodiments, the air-fuel mixture permeable body 123 is disposed so as to cover the opening 122 of the burner frame 121. This invention is also applicable to a totally aerated combustion burner in which the air-fuel mixture permeable body and the distribution plate are arranged to be cylindrical in shape so that the air-fuel mixture supplied to the cylindrical inner space is ejected outward through the distribution holes and the air-fuel mixture permeable body.

EXPLANATION OF MARKS

1 totally aerated combustion burner
12 combustion plate part
123 permeable body through which an air-fuel mixture is permeable (also called "air-fuel mixture permeable body")
$\mathbf{123}_1$, $\mathbf{123}_2$, $\mathbf{123}_3$ metallic-fiber woven body
123*a* metallic fiber
123*b* metallic-fiber threads
123*c* mesh
124 distribution plate
124*a* distribution hole

What is claimed is:

1. A totally aerated combustion burner comprising:

a combustion plate part through which an air-fuel mixture is ejected, the combustion plate part including:

an air-fuel mixture permeable body made from metallic fibers to allow the air-fuel mixture to pass therethrough; and a distribution plate having formed therein a multiplicity of distribution holes, and being stacked on a back surface of the air-fuel mixture permeable body, the back surface being defined as an upstream-side surface as seen along a flow of the air-fuel mixture through the air-fuel mixture permeable body, whereby the air-fuel mixture can be ejected through the distribution holes and the air-fuel mixture permeable body, wherein the air-fuel mixture permeable body is constructed by laminating a plurality of metallic-fiber woven bodies, each of the metallic-fiber woven bodies being made by weaving metallic-fiber threads obtained by bundling a plurality of metallic fibers; and wherein the plurality of metallic-fiber woven bodies are laminated such that part of meshes in one metallic-fiber woven body that lies adjacent to another metallic-fiber woven body in a laminating direction, overlaps a portion other than meshes in said another metallic-fiber woven body.

2. The totally aerated combustion burner according to claim 1, wherein a number of metallic fibers per one metallic-fiber thread for said one metallic-fiber woven body is smaller than the number of metallic fibers per one metallic-fiber thread for said another metallic-fiber woven body, and wherein the meshes in said one metallic-fiber woven body are smaller in size than the meshes in said another metallic-fiber woven body.

3. The totally aerated combustion burner according to claim 1, wherein the plurality of metallic-fiber woven bodies are constructed by the same kind of metallic-fiber woven bodies of the same size in the meshes obtained by weaving the same kind of metallic-fiber threads which are the same in number of metallic fibers per one metallic thread, and wherein a course direction of said one metallic-fiber woven body crosses the course direction of said another metallic-fiber woven body.

4. The totally aerated combustion burner according to claim 1, wherein the plurality of metallic-fiber woven bodies are constructed by weaving the same kind of metallic-fiber threads that are equal in number of metallic fibers per one metallic-fiber thread, and wherein the shape of the meshes in said one metallic-fiber woven body, and the shape of the meshes in said another metallic-fiber woven body are made different from each other by varying the way of weaving the meshes.

* * * * *